US009980870B2

(12) United States Patent
Jacobs

(10) Patent No.: US 9,980,870 B2
(45) Date of Patent: May 29, 2018

(54) CHIROPRACTIC ADJUSTMENT INSTRUMENT

(76) Inventor: Darryl Jacobs, Bournemouth (GB)

( * ) Notice: Subject to any disclaimer, the term of this patent is extended or adjusted under 35 U.S.C. 154(b) by 0 days. days.

(21) Appl. No.: 14/119,687

(22) PCT Filed: May 16, 2012

(86) PCT No.: PCT/GB2012/000438

§ 371 (c)(1),
(2), (4) Date: Jan. 2, 2014

(87) PCT Pub. No.: WO2012/160326

PCT Pub. Date: Nov. 29, 2012

(65) Prior Publication Data

US 2014/0188169 A1 Jul. 3, 2014

(30) Foreign Application Priority Data

May 26, 2011 (GB) ..... 1108943.0

(51) Int. Cl.
*A61H 1/00* (2006.01)
*A61H 23/02* (2006.01)

(52) U.S. Cl.
CPC ..... *A61H 1/008* (2013.01); *A61H 2201/0153* (2013.01); *A61H 2201/1215* (2013.01); *A61H 2201/149* (2013.01); *A61H 2201/1685* (2013.01); *A61H 2201/5025* (2013.01)

(58) Field of Classification Search
CPC ..... A61H 1/008; A61H 2201/0153; A61H 23/0254; A61H 23/0218
USPC ..... 601/97–98, 101, 107–108; 606/237–239
See application file for complete search history.

(56) References Cited

U.S. PATENT DOCUMENTS

| | | | | |
|---|---|---|---|---|
| 2,204,259 | A | 6/1940 | Schuster et al. | |
| 4,116,235 | A | 9/1978 | Fuhr | |
| 4,549,535 | A | 10/1985 | Wing | |
| 4,566,442 | A * | 1/1986 | Mabuchi et al. | 601/101 |
| 4,669,454 | A * | 6/1987 | Shamos | 606/238 |
| 4,716,890 | A * | 1/1988 | Bichel | 601/108 |
| 5,626,615 | A * | 5/1997 | Keller et al. | 606/238 |
| 5,632,765 | A * | 5/1997 | Holder | 606/238 |
| 5,656,017 | A * | 8/1997 | Keller et al. | 601/108 |
| 6,228,042 | B1 | 5/2001 | Dungan | |
| 7,144,417 | B2 | 12/2006 | Colloca | |

(Continued)

FOREIGN PATENT DOCUMENTS

| | | |
|---|---|---|
| WO | WO2007/103987 | 9/2007 |
| WO | WO2009/014727 | 1/2009 |

*Primary Examiner* — Justine Yu
*Assistant Examiner* — Christopher Miller
(74) *Attorney, Agent, or Firm* — William H. Bollman

(57) ABSTRACT

The invention provides a cordless chiropractic adjustment device including a thrust element (80) capable of impacting a body contact member (10), a resilient spring (314) arranged to bias the thrust element towards the body contact member, and a motor (120). The motor is arranged to move the thrust element between a variable primed configuration in which the thrust element is held out of contact with the body contact member, and a fired configuration in which the thrust element is propelled by the resilient spring into contact with the body contact member through a range of different impact forces. The motor is provided with direct current by one or more batteries (150), which may be rechargeable.

18 Claims, 28 Drawing Sheets

(56) References Cited

U.S. PATENT DOCUMENTS

| | | | | |
|---|---|---|---|---|
| 2003/0195443 | A1* | 10/2003 | Miller | 601/108 |
| 2005/0131461 | A1* | 6/2005 | Tucek et al. | 606/239 |
| 2006/0293711 | A1 | 12/2006 | Keller | |
| 2009/0270915 | A1* | 10/2009 | Tsai et al. | 606/238 |
| 2010/0137907 | A1 | 6/2010 | Tsai | |

* cited by examiner

2ND PART
REAR PART MOTOR RETENTION MEMBER

CHIROPRACTIC ADJUSTMENT INSTRUMENT

FIELD OF THE INVENTION

This invention relates to chiropractic adjustment instruments, in particular to an adjustment device used for spinal manipulation.

BACKGROUND OF THE INVENTION

A form of therapy used by chiropractors in their practice is spinal manipulation. This is a therapeutic intervention performed on synovial joints in the spinal column, and intended to relieve symptoms of back pain.

Known instruments for assisting with such manipulation include devices which require the chiropractor to pre-load or arm the device by pulling a handle against the action of a strong spring force. The continued use of such devices can lead to development of carpal tunnel syndrome, lateral epicondylitis (tennis elbow), or other debilitating injuries.

More recently, chiropractic adjustment instruments which use alternating current to counter the strong spring force have been developed. However, such devices have other drawbacks such as lengthy cables which may cause a trip hazard.

PRIOR ART

U.S. Pat. No. 4,116,235 (Fuhr) discloses a manually operated chiropractic adjusting instrument having a longitudinally reciprocal spring biased member with a resilient body contact element on the end thereof, and a manually moveable handle connected thereto for compressing the resilient spring. There are adjustable means for controlling the compression of the spring.

U.S. Pat. No. 5,626,615 (Keller and Fuhr) discloses a chiropractic adjusting instrument for exciting the human spine at its natural frequency. It comprises a body contact member removably attached to a thrust element, a spring means for propelling the thrust element and the body contact member outwardly, and an adjustment knob for controlling the magnitude of the force input to the body contact member.

U.S. Pat. No. 7,144,417 (Colloca) discloses a chiropractic adjusting instrument comprising an electronic pulse system connected to a power source to provide alternating current for energising a solenoid to impart energy from a core to a thrust nose piece. The alternating current supply is provided via a cable and plug. The cable presents a trip hazard and limits the portability of the instrument.

US Patent Application number US-A-2006/0293711 (Keller et al) discloses a chiropractic adjuster for applying an adjustment energy to a patient through a plunger having a resilient or cushioned head. The energy applied to the plunger is supplied by non-mechanical sources and the impulse is adjustable but only in a crude sense and fine adjustment has not always been achievable in a repeatable manner. The power supply may have a rechargeable battery, a removable rechargeable battery pack or an air cartridge.

U.S. Pat. No. 6,228,042 (Dungan) discloses a chiropractic adjustment tool. It comprises a housing, a striker assembly disposed within the housing; and a plunger device or plunger disposed externally to the housing. The plunger is in communication with the striker assembly. A power source provides power through a series of gears and springs to move the striking rod in reciprocating fashion.

International Patent Application number WO-A-2007/103987 (Colloca et al) provides a chiropractic adjustment instrument. It comprises a housing; a thrust nose piece and an impact head to contact a body; a pre-load switch plunger; a dampening spring; a solenoid having a core; an internal pre-load spring; a recoil spring; an electronic pulse system connected to a power source to provide alternating current for energizing the solenoid; and a trigger system for triggering the electronic pulse system comprising a switch activated by the pre-load switch plunger.

International Patent Application number WO 2009/014727 (Activator Methods International Limited) discloses a portable battery operated chiropractic adjustor for applying an adjustment energy to a patient. The battery operated chiropractic adjustor comprises a plunger having a resilient or cushioned head with the energy applied to the plunger being supplied by non-manual sources. The impulse is adjustable for preload and readiness to operate. The power source may be an internal rechargeable battery pack, and the adjuster is a DC motor operated to impart selectively single or multiple thrusts.

Despite being successful to varying degrees, extensive use of some of the aforementioned devices has increased the risk of repetitive strain injury to the user.

Additionally some of the prior art devices were bulky and required a large current in order to power them.

Another disadvantage with many of the aforementioned devices was that some required a mains lead connecting the devices to a mains power supply. This not only rendered the devices bulky and difficult to transport, but limited their usefulness as the leads often interfered with the chiropractor's treatment regime.

SUMMARY OF THE INVENTION

In accordance with a first aspect, the present invention provides a cordless chiropractic adjustment device, adapted to receive at least one battery which in use provides direct current to a motor, includes a thrust element capable of impacting a body contact member, a resilient spring arranged to bias the thrust element towards the body contact member and a motor arranged to move the thrust element between a variable primed configuration, in which the thrust element is held out of contact with the body contact member, and a fired configuration in which the thrust element is propelled by the resilient spring into contact with the body contact member in order to deliver a predetermined force.

An advantage of the feature that enables a user to select the degree of primed configuration, is that the practitioner is able to select the amount of force with which the body contact member impacts the patient. This ability to vary the impact force provides a unique ability to the practitioner to select the precise amount of force, as well as determine the axis of application of the force, that may be needed.

Since the device is a cordless device powered by internal batteries there are no power cables to cause a potential trip hazard. Moreover, the battery-powered motor ensures that the device can be primed (i.e. arranged in the primed configuration) without any manual effort, thus preventing medical complaints such as carpal tunnel syndrome or tennis elbow.

The body contact member of the device preferably comprises an anvil member.

An arrangement of bespoke springs, with different spring rates, ensure that desired amount of impact force is applied as well as the device is able to operate with the desired frequency of impact, quietly and without causing alarm to a patient.

Furthermore, by utilising a direct current supply, the chiro clinician is assured that the treatment provided by the device is controlled and repeatable. Prior art devices which use an alternating current supply, on the other hand, must include control systems to adjust for power fluctuations, surges or other power variations.

The device may further comprise a second resilient spring arranged to be held under compression by the anvil member so as to control the amount of force with which the body contact member is fired. The amount of compression applied to the second resilient spring can be adjusted by an adjustment member, which causes relative longitudinal movement of the anvil member. For example, the adjustment member may be a nose cone member.

The nose cone member ideally comprises a frusta-conical portion which can be gripped and rotated by a clinician or chiropractor. Rotation of the nose cone member may cause relative longitudinal movement of the anvil member. The relative longitudinal movement of the anvil member causes compression of the second resilient spring. The amount of compression of the second resilient spring can be varied so as to control the amount of force with which the body contact member is fired.

The device is preferably an electro-magnetically operated cordless device for spinal manipulation. The body contact member may have a contact face having any suitable shape and dimensions for contact with the patient. For example, the body contact member may comprise a cylindrical portion having a circular end face for contact with the patient. The contact face may be shaped and dimensioned to receive and engage a cover portion, for example a rubber tip.

Preferably the cover portion, for example the rubber tip, resiliently engages the contact face. The cover portion, for example the rubber tip, may deform to fit over an engagement feature of the body contact member, for example the cover portion may extend over the end face of the body contact member. The cover portion, for example the rubber tip, may have a cylindrical cross-section. The cover portion, for example the rubber tip, may taper inwardly towards the proximal end face of the cover portion. The cover portion, for example the rubber tip, may provide a circular end face for contact with the patient.

The contact face of the body contact member and the cover portion may have one or more mutual engagement features, such as for example protrusions or recesses. The mutual engagement features may provide for resilient engagement of the contact face and the cover portion. For example, the cover portion may provide a flexible annular ring extending in a plane perpendicular to the longitudinal axis of the cover portion.

The annular ring may be provided at the distal end of the cover portion. The flexible annular ring may be dimensioned and shaped to resiliently engage an annular recess provided by the body contact member adjacent to the contact face. The cover portion, for example the rubber tip, may be provided as a cushion for the applied force to the point of contact on the patient.

The thrust element ideally comprises a piston member slidable within a tube member, and the resilient spring is a coil spring. The motor is preferably a direct current electric motor, and the one or more batteries are preferably two, lithium-ion batteries.

Preferably, the device includes a switch, closure or opening of which switch is arranged to cause the motor to first propel the thrust element to the fired configuration and subsequently return the device to the armed configuration.

In this way, the device is always armed and ready for use. Moreover, the thrust force is delivered immediately on pressing the switch, with no delay for arming of the device. During such delays, which are a feature of prior art devices, the device may move in position or attitude, thus potentially jeopardising the treatment. In particular, prior art devices require the clinician to hold the device in situ with the same hand that performs the arming step, with the inevitable risk that the hand movement required for arming causes unwanted movement of the device. The present invention may address this problem by ensuring that the device is armed immediately after it is fired.

The switch is preferably arranged at an end of the device directly opposite to the body contact member. Thus, the device can be easily and simply activated.

Preferably, the switch is arranged centrally within a concave palm rest for seating a user's palm. This arrangement enables straightforward one-handed stabilisation and activation of the device.

The device may comprise a tube member through which the thrust member is able to be propelled into the body contact member, and locking means having a locked configuration in which sliding of the thrust member within the tube member is prevented, and an unlocked configuration in which the thrust member is slidable within the tube member. Thus, when the locking means is in the locked configuration the thrust member can be withdrawn to the primed configuration. When the locking means is in the unlocked configuration the thrust member is free to be propelled through the tube member to the fired configuration.

The device may comprise a thread start member arranged to convert rotation of a shaft of the motor to linear movement of the thrust element. Preferably, the thread start member has an external male screw thread arranged to cooperate with a female screw thread of the tube member. The cooperating screw threads may be provided with a multi start thread. As such, the thread start member may comprise a multi-start drive. The force provided by the instrument of the invention can be selected between 'very high and very little' in a smooth and continuous way rather than in a binary, variable or stepwise manner. The present invention therefore provides the clinician with a greater choice of force to be used in the treatment of the patient.

In a second aspect, the present invention provides a chiropractic adjustment apparatus including a chiropractic adjustment device according to the first aspect and a recharging cradle arranged to receive the chiropractic adjustment device to recharge its batteries.

The recharging cradle preferably has means for electrical connection with an alternating current power supply, e.g. an electrical cable connected at one end to the cradle and at the other end to a two- or three-pronged electrical plug adapted for connection to an electrical socket.

The electric plug is typically adapted to be connected to a mains electric supply (for example 230/240 V AC). The cradle may therefore further comprise an AC adapter to provide an appropriate DC electrical supply to charge the batteries. The recharging cradle is preferably arranged to receive the palm rest end of the device. The recharging cable preferably has a corresponding complimentary shape to receive the instrument.

The recharging cradle preferably provides at least one electrical connector arranged for engagement with the device to provide an electrical connection with the one or more batteries of the device.

The instrument preferably comprises at least one corresponding female connector for receiving the at least one connector of the recharging cradle. The female connector may be provided with a sprung cover which is opened by the connector of the recharging cradle. The recharging cradle preferably has a complimentary shape to receive the instrument and to align the connectors.

The invention will now be described, by way of example only, with reference to the accompanying drawings, in which:—

DETAILED DESCRIPTION OF THE ILLUSTRATED EMBODIMENT

Figure 1:
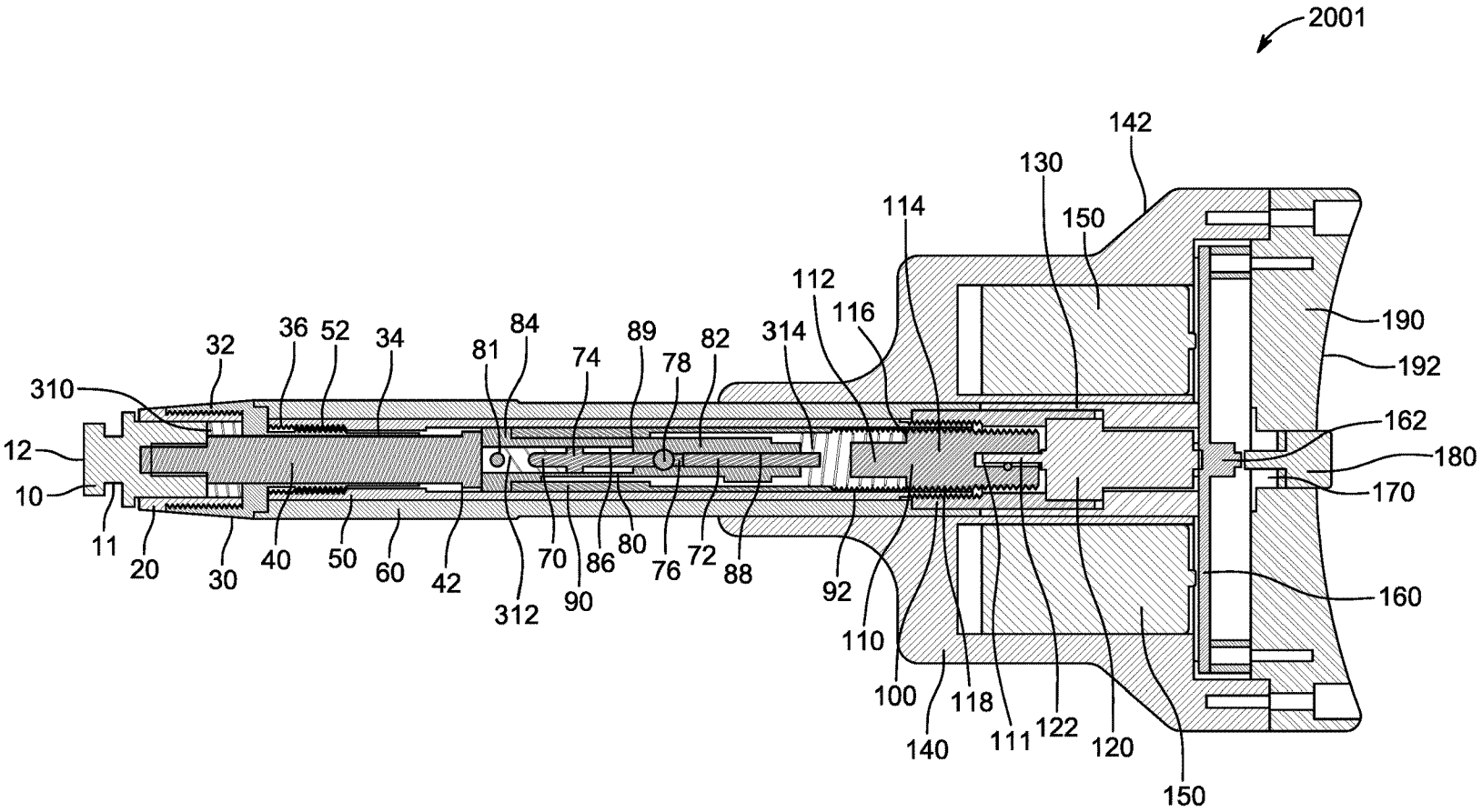
FIG. 1 is a longitudinal view of major elements of a chiropractic adjustment instrument according to an embodiment of the present invention.
Figure 2:
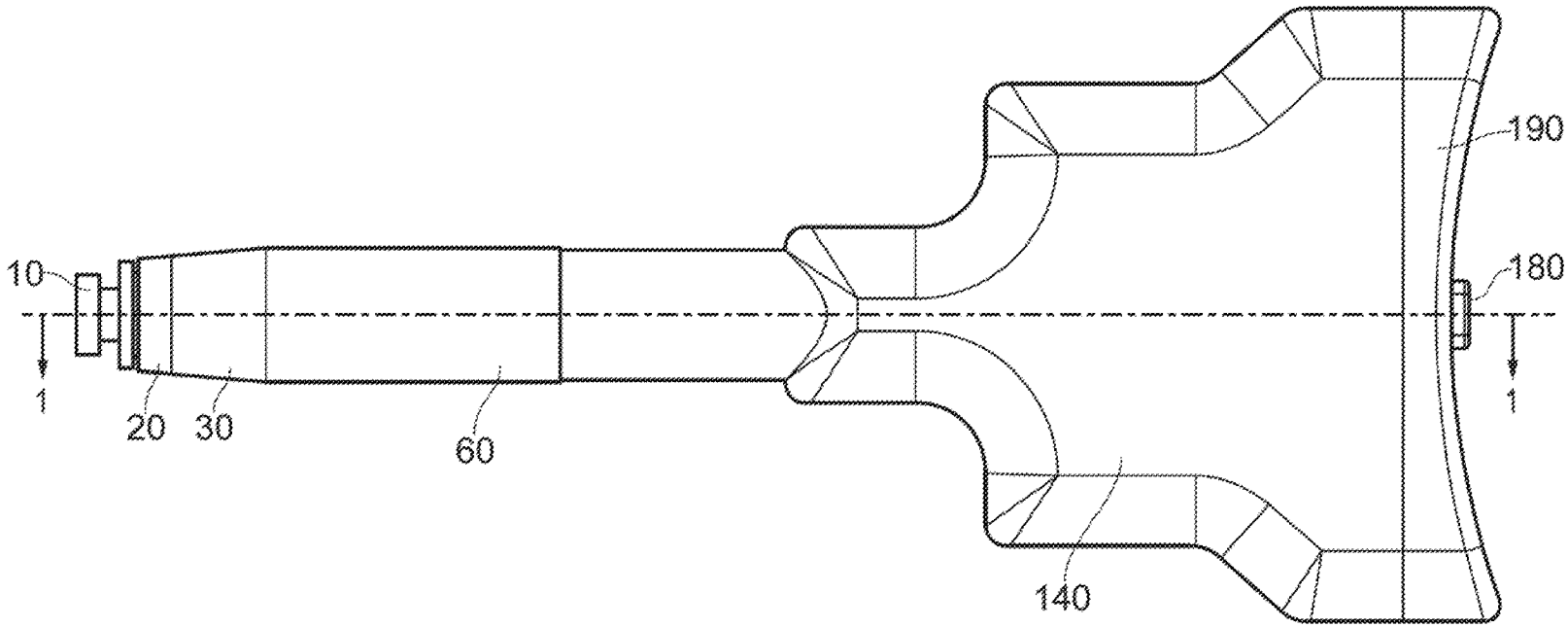
FIG. 2 is a plan view of the instrument of FIG. 1.
Figure 3A:
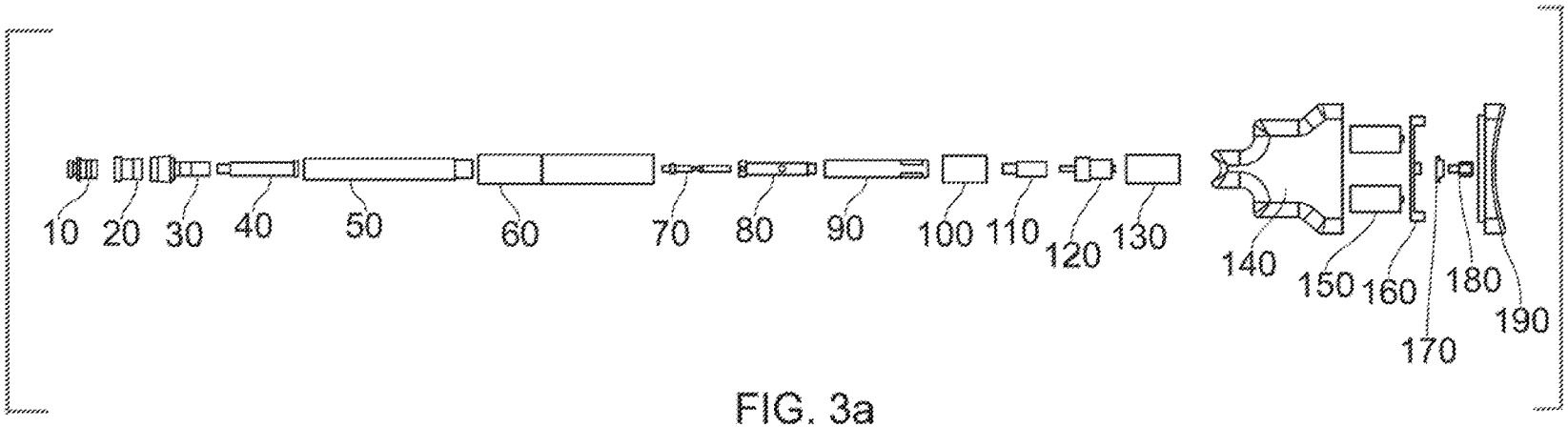
FIGS. 3*a* and 3*b* are exploded internal views of alternative embodiments, showing component parts of the instrument of FIG. 1.

FIGS. 1 to 3 illustrate a chiropractic adjustment device 2001 according to an embodiment of the present invention. It is to be appreciated that these figures are for illustration purposes only and other configurations are possible.

Figure 4B:
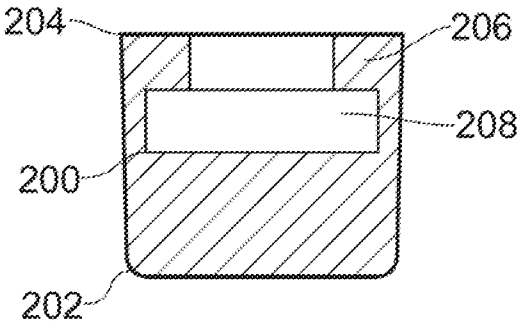
FIGS. 4*a* to 4*c* are cross-sectional, longitudinal sectional and side views of the rubber tip for engagement with the instrument of FIG. 1.
Figure 4A:
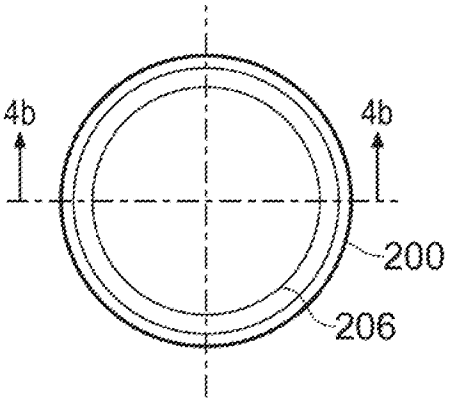
Figure 4C:
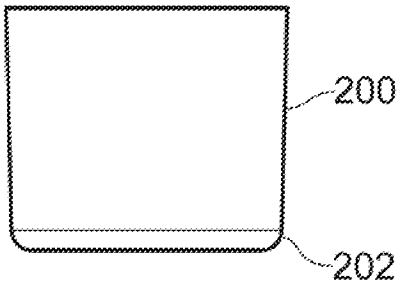

The device 2001 is generally elongate and has at one end a body contact member 10 with a contact face 12 for placing a rubber tip (as shown in FIGS. 4A to 4C) in contact with a patient (not shown) and at the other end a palm rest 190 with a concave face 192 for seating the hand of a clinician (not shown). The rubber tip (shown in detail in FIG. 4) is optionally removable and is provided as a cushion of the applied force to the point of contact. The palm rest 190 is fixed at its periphery to a housing 140 which houses a motor 120 arranged between two batteries 150. Ideally batteries 150 are connected in parallel and are also charged in this configuration.

The motor 120 is supported within a generally cylindrical motor retention member 130, and a contact board 160 provides an electrical connection between the batteries 150 and the motor 120. The housing 140 has an exterior surface 142 which generally tapers with distance from the palm rest 190 such that it can be readily gripped by a clinician.

In this embodiment, batteries 150 are rechargeable lithium-ion batteries. The batteries 150 are recharged by placing the device 2001 on a recharging cradle (not shown).

At the centre of the concave face 192 of the palm rest 190 is a button 180 which has a rest configuration (as shown in FIG. 1) in which it projects outwardly from the concave face 192 and an activated configuration in which it is retracted into the palm rest 190 so that it contacts a contact projection 162 of the contact board 160. This contact between the contact projection 162 and the button 180 causes motor 120 to be activated. The button 180 is seated within a switch retention member 170 which has a bore through which a shaft of the button 180 is guided. An advantage with the palm rest and overall shape of the The motor 120 has a rotatable shaft 122 which is connected via a keyed joint to a corresponding cavity 111 in a start thread member 110 such that rotation of the shaft 122 causes corresponding rotation of the start thread member 110. The start thread member 110 comprises a solid body having two coaxial cylindrical portions with different diameters, the small diameter portion 112 and large diameter portion 114 forming a shoulder 116 therebetween. The cavity 111 is formed along the longitudinal axis of the large diameter portion 114 so that it extends towards the small diameter portion 112.

The amount of rotation and speed of rotation of the shaft is controllable. Control can be achieved in a number of ways. For example, a resistor can be connected to the shaft in order to provide an output whose resistance is indicative of the amount of rotation of the shaft.

Figure 3B:
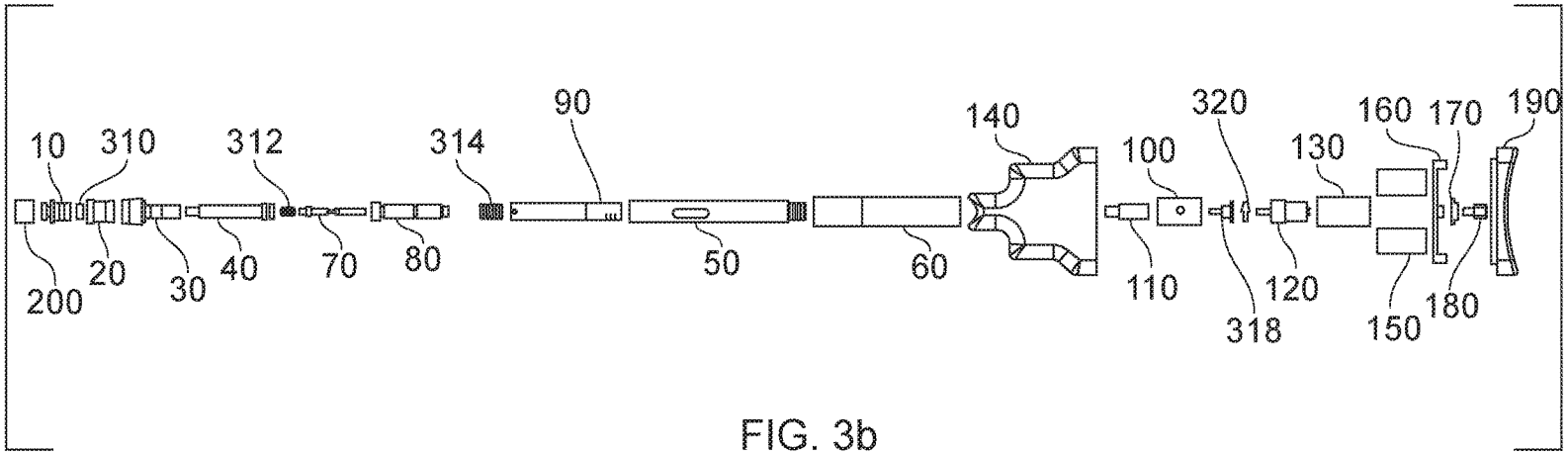

Alternatively a shaft encoder may include an opto-encoder, such as for example, the type of shaft encoder 318, 320 shown in FIG. 3*b*. In the embodiment shown in FIG. 3*b* all parts bear the same reference numerals as in FIG. 3*a*. Therefore only the additional features have been annotated. These additional features are: a nose spring 310 which acts to ensure that a consistent amount of force is applied by pre-loading tension, as a practitioner places the instrument in contact with a patient's body, whether this is in direct contact with a patient's skin or through thick clothing.

The nose spring 310 therefore ensures that, in relative terms, anvil member 40 is located at the same initial position and the desired amount of stroke is achieved before impact. This is important if for example a chiropractor is using the instrument to work on relatively delicate cervical vertebrae directly, rather than say a patient's spine, through their clothing. Referring again to FIG. 3*b* there is also provided main, and internal springs 314 and 312.

The large diameter portion 114 has an external male screw thread 118 formed along its entire length, the male thread 118 interconnecting with a female screw thread 92 formed along an end region of a tube member 90. Thus, rotation of the start thread member 110 by the motor 120 causes the tube member 90 to move linearly with respect to the start thread member 110.

The tube member 90 comprises an elongate hollow tube with two coaxial cylindrical bores therein, the large diameter bore portion 114 and small diameter bore portion 112 forming a shoulder 98 therebetween, and the large diameter bore portion 114 carrying the female screw thread 92. Within the tube member 90, and extending through both the large diameter bore portion 114 and small diameter bore portion 112 in the manner of a piston, is the thrust element comprising the hammer member 80.

The hammer member 80 comprises a generally cylindrical portion 82 which has an outer diameter sized for a close sliding fit with the small diameter bore 96, and a head portion 84 which has a larger outer diameter than the cylindrical portion 82. A bore extends along the axial length of the hammer member 80, the bore having a large diameter bore portion 86 extending through the head portion 84 and into the cylindrical portion 82, and a small diameter bore portion 88 extending through the remainder of the cylindrical portion 82. A shoulder 89 is formed between the large 86 and small 88 diameter bore portions.

Within the large 86 and small 88 diameter bore portions of the hammer member 80 is a firing pin 70, the firing pin 70 having an elongate cylindrical portion 72 with an outer diameter sized so as to provide a close sliding fit within the small diameter bore portion 88 of the hammer member 80. The cylindrical portion 72 also has a short reduced-diameter portion 76. At one end of the firing pin 70 is a flange portion 74 sized to fit within the large diameter bore portion 86 and arranged to abut the shoulder 89 of the hammer 80 to limit the movement of the firing pin 70 within the hammer 80.

The firing pin 70 is activated by the two ball bearings 78. In the firing configuration shown in FIG. 1 the ball bearings 78 are located in the ball bearing apertures 85 and the radial gap between the reduced-diameter portion 76 of the firing pin 70 and the small diameter bore portion 88 of the hammer 80. In this configuration the ball bearing 78 does not protrude beyond the cylindrical portion 82 of the hammer member 80 and therefore does not impede the motion of the hammer 80 within the tube member 90. In the armed (i.e. pre-firing) configuration the ball bearings 78 are located within the cylindrical portion 82 of the hammer member 80, so preventing linear movement of the hammer 80 relative to the tube member 90.

In this armed configuration, linear movement of the tube member 90 away from the body contact member 10 (caused by rotation of the start thread member 110 by the motor 120) causes the hammer 80 to be drawn back against the resisting force provided by the first coil spring 314 that extends between the hammer member 80 and shoulder 116 of the start thread member 110.

The tube member 90 is slidably located within an internal tube member 50, which itself is located within an outer tube member 60. At one end, the outer tube member 60 interconnects with the housing 140 and abuts the motor retaining tube 130 and outer tube extension 100. At the other end, a generally cylindrical anvil member 40 is located within the internal tube member 50. The anvil member 40 is connected at one end to the body contact member 10 and at the other end is face to face with the head portion 84 of the hammer member 80.

A nose cone member 30 comprises a frusto-conical portion 32, 20 which can be gripped so as to be rotated by the clinician, and a hollow cylindrical portion 34 with a male screw thread 36 which cooperates with a female screw thread 52 of the internal tube member 50. Rotation of the nose cone member 30 thus causes relative longitudinal movement between the nose cone member 30 and the internal tube member 50. The cylindrical portion 34 of the nose cone member 30 is affixed to the anvil member 40 such that rotation of the nose cone member 30 causes longitudinal movement of the anvil member 40 within the internal tube member 50.

A second coil spring knot shown) is compressed between a shoulder 42 of the anvil member 40 and a shoulder 54 of the internal tube member 50, such that the amount of compression applied to the second coil spring can be adjusted by rotation of the nose cone member 30 to cause movement of the shoulder 42 of the anvil member 40 relative to the shoulder 54 of the internal tube member 50. By controlling the compressive force within the second coil spring, the amount of force with which the body contact member 10 is fired can be controlled.

The instrument may optionally include a synthetic rubber tip 200, formed from a suitable material that will deform in a controllable way as well as act to transfer a proportion of the linear force to a patient in such as way as to desired by the chiropractor, but without damaging tender tissue. Ideally the synthetic rubber tip 200 is made from Neoprene (Trade Mark) and an example is shown in FIGS. 4*a* to 4*c*. The rubber tip 200 has a cylindrical cross-section which tapers inwardly towards the proximal end face 202 of the tip. The proximal end face 202 of the tip has a circular cross-section for contact with the patient. The distal end 204 of the rubber tip 200 provides a flexible annular ring 206 and a recess 208 shaped and dimensioned to receive the contact face 12 of the instrument.

The annular ring 206 is shaped and dimensioned to resiliently engage the recess 11 provided adjacent to the contact face 12 of the body contact member 10 of the instrument.

Figure 5A:
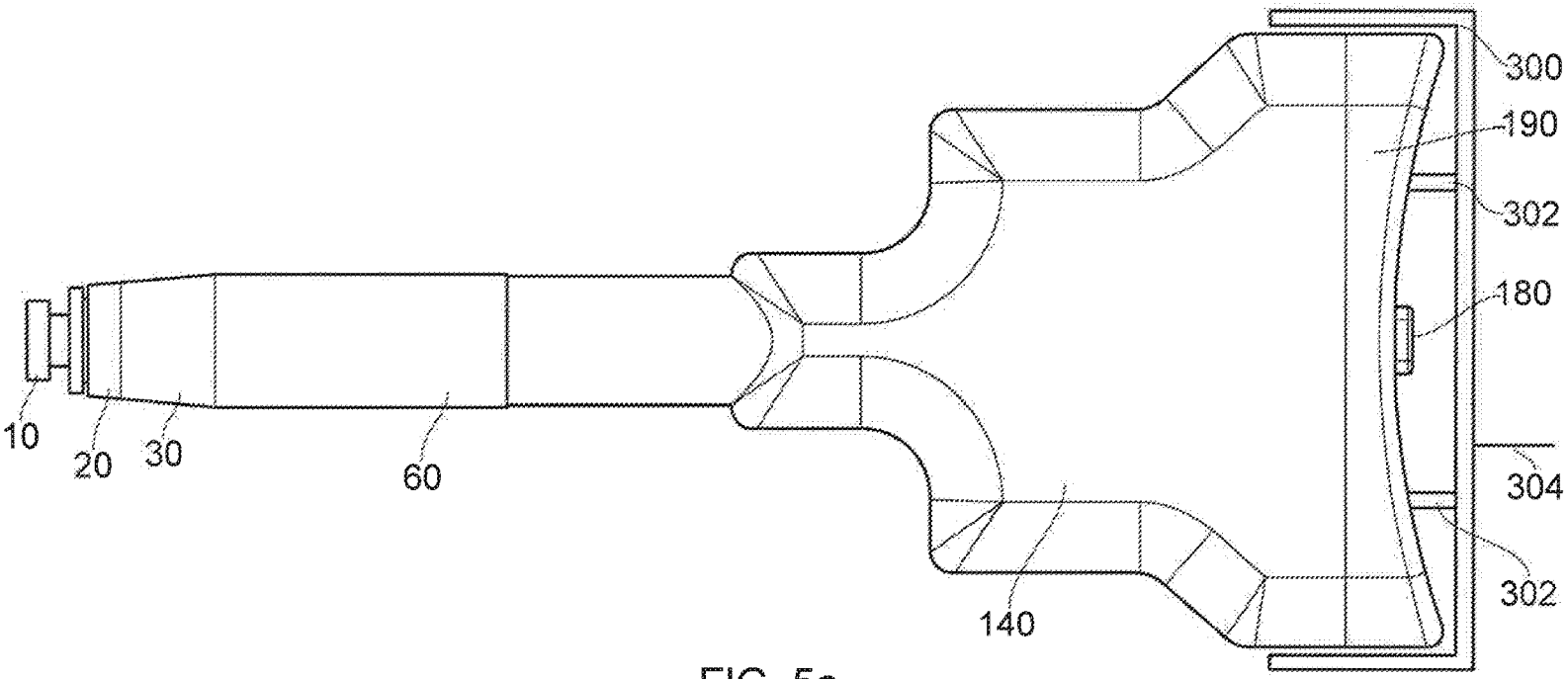
FIG. 5*a* is a plan view of the instrument in a recharging cradle for recharging batteries.
Figure 5B:
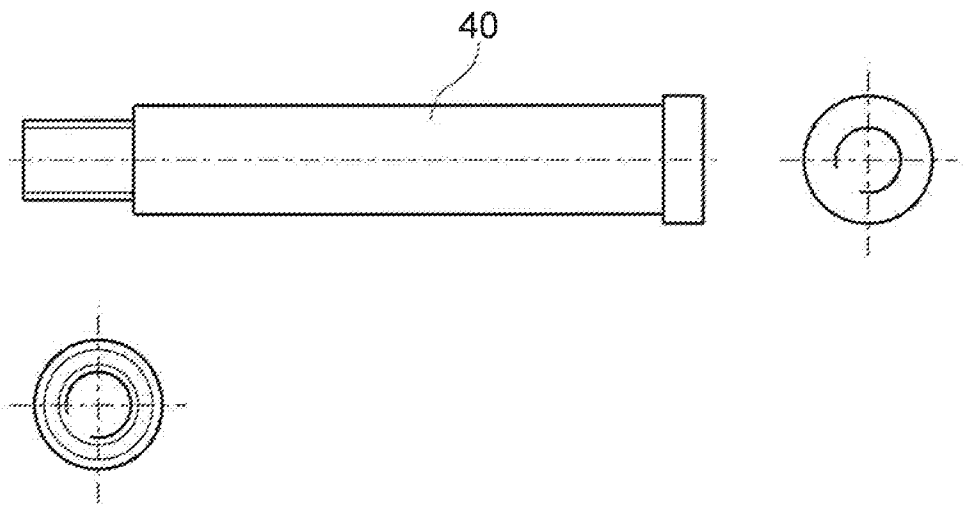
FIG. 5*b* is a plan view of the anvil of the instrument of FIG. 1.

FIG. 5*a* illustrates the recharging cradle 300 enabling the instrument rechargeable batteries 150 to be recharged. The recharging cradle 300 provides at least one electrical connector 302 arranged to provide an electrical connection with the batteries 150. The instrument comprises at least one corresponding female connector (not shown) for receiving the connector 302. The female connector may be provided with a sprung cover which is opened by the connector 302.

The recharging cradle 300 has a complimentary shape to receive the instrument and to align the connectors. The recharging cradle 300 has an electrical cable 304 connected at one end to the cradle 300 and at the other end an electrical plug (not shown) adapted for connection to an electrical socket. The electric plug (not shown) is typically arranged to be connected to a mains electric supply (for example 230/240V AC). The cradle will therefore further comprise an A.C. adapter to provide an appropriate direct current (DC) electrical supply to the batteries 150.

In use, the clinician or chiropractor ensures the batteries 150 are charged by connecting the instrument to the recharging cradle 300. The palm rest 190 is inserted into the recharging cradle 300 and the batteries 150 form an electrical connection with the connectors 302 of the recharging cradle 300. The clinician then removes the instrument from the recharging cradle 300 and adjusts the nose cone member 30 to achieve the desired level of force to be administered. Optionally the contact face 12 is covered with the rubber tip 200 by inserting the contact face 12 into the recess 208 of the rubber tip 200. The annular ring 206 of the rubber tip 200 resiliently engages the recess 11 provided by the body contact member 10.

In use a clinician then places the end face 202 of the rubber tip 200 or the contact face 12 of the body contact member 10 in contact with the patient's skin at the treatment site and aligns the longitudinal axis of the instrument 200 with the desired treatment direction. The clinician then seats the device on the palm rest 190 and presses the button 180. This has the effect of activating the motor 120 to cause ball bearing 78 to move so as to permit movement of the hammer 80 within the internal tube member 50.

Propelled by the action of the compressed first coil spring 314 (shown in FIG. 3*b*), the hammer 80 is fired towards the anvil 40, which is itself propelled outwardly so that the body contact member 10 applies a controlled amount of thrust force to the patient.

The optional rubber tip 200 provides a cushion of the applied force to the point of contact. The motor 120 then immediately acts to rotate the start thread member 110 to draw the hammer 80 back to the armed (pre-firing) position against the action of the first coil spring. In the armed position the ball bearing 78 is located so as to prevent movement of the hammer 80 within the internal tube member 50.

Reference will now be made to FIGS. 6 to 26 which show the aforementioned features in greater detail. These additional Figures are included so that the skilled person is able to produce the invention, with reference to the aforementioned description.

Figure 6A:
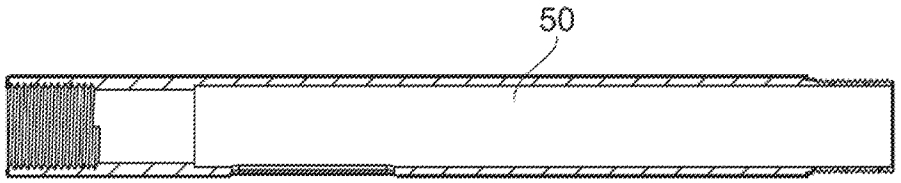
FIGS. 6*a* to 6*c* are sectional, elevation and overall views of the body of the instrument of FIG. 1.
Figure 6B:
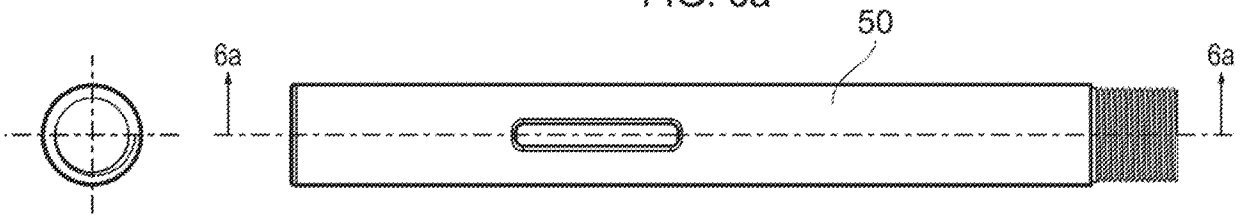
Figure 6C:
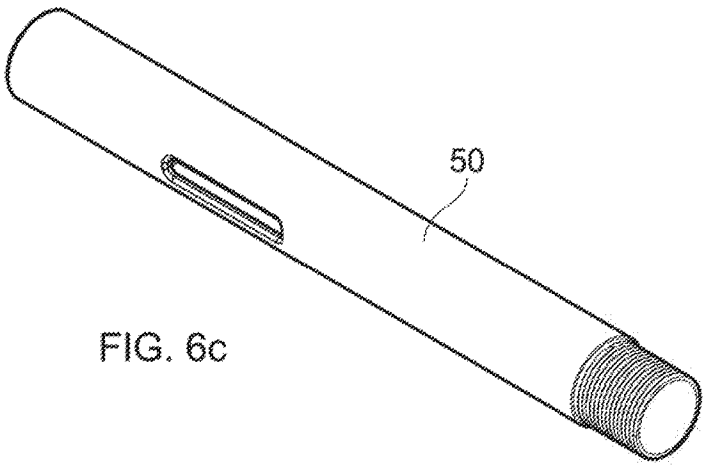
Figure 7A:
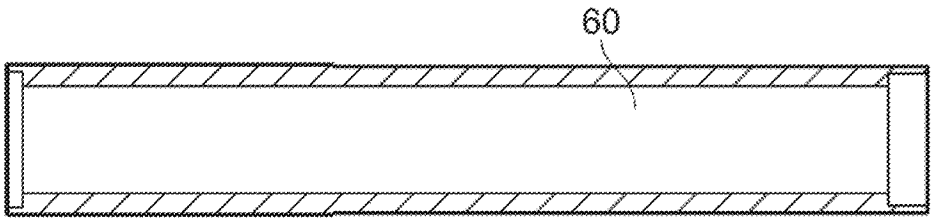
FIGS. 7*a* to 7*c* are sectional, elevation and overall views of the outer body of the instrument of FIG. 1.
Figure 7B:
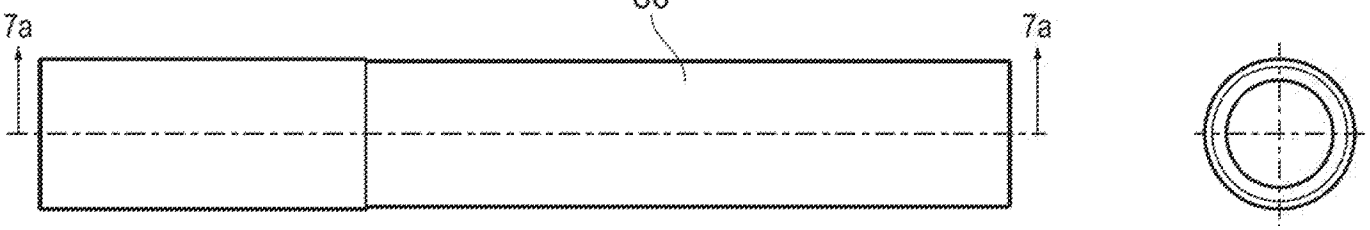
Figure 7C:
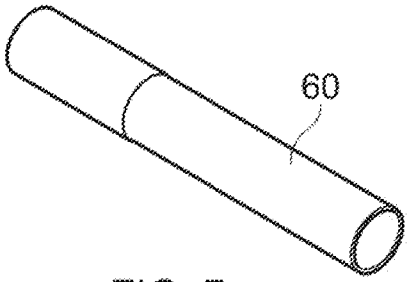
Figure 8C:
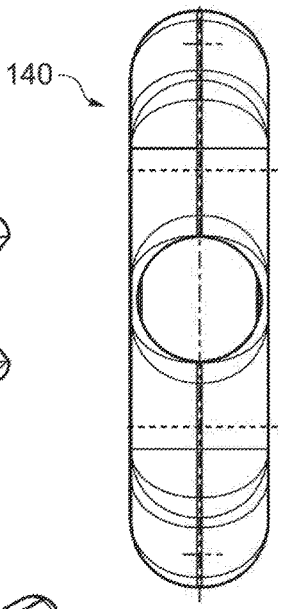
FIGS. 8*a* to 8*d* are sectional, front and side elevation and overall views of the handle of the instrument of FIG. 1.
Figure 8B:
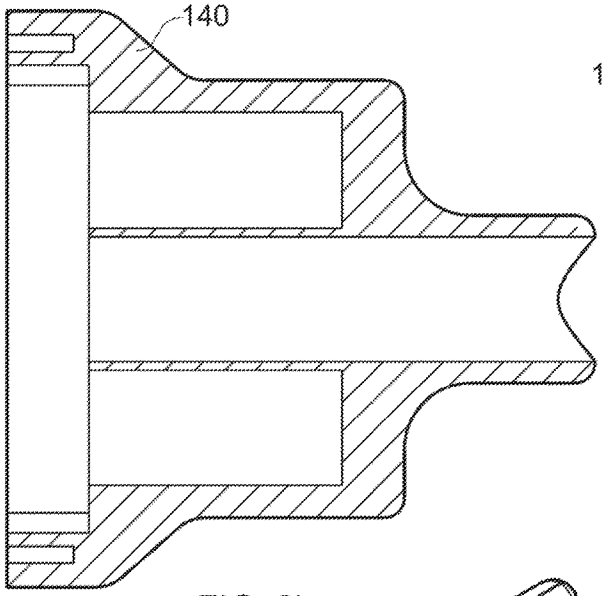
Figure 8D:
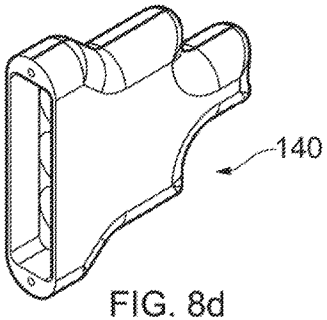
Figure 8A:
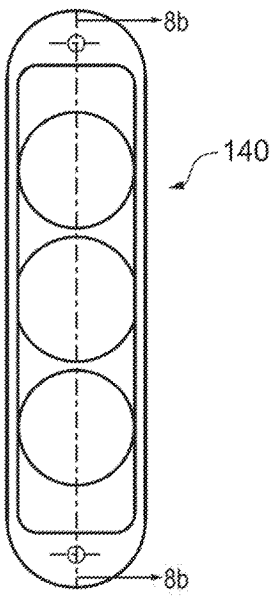
Figure 9A:
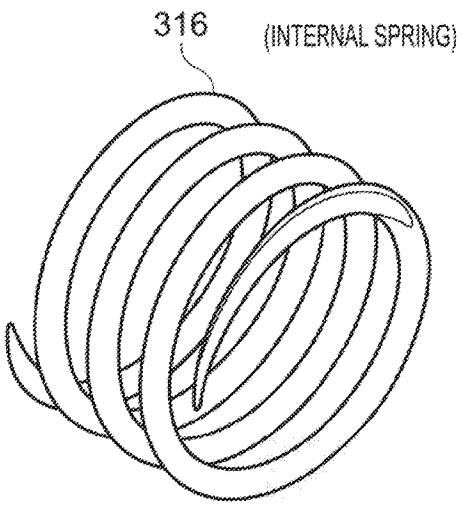
FIGS. 9*a* to 9*d* are sectional, front and side elevation and overall views of the internal spring of the instrument of FIG. 1.
Figure 9B:
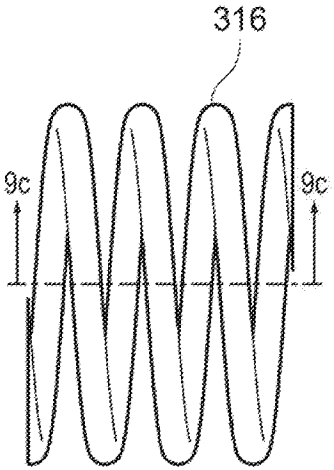
Figure 9C:
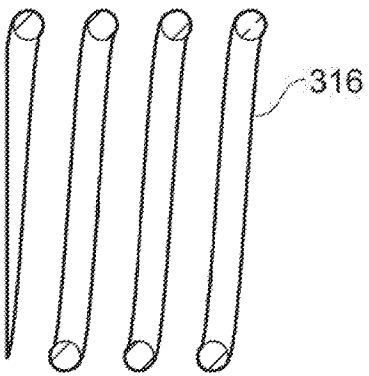
Figure 9D:
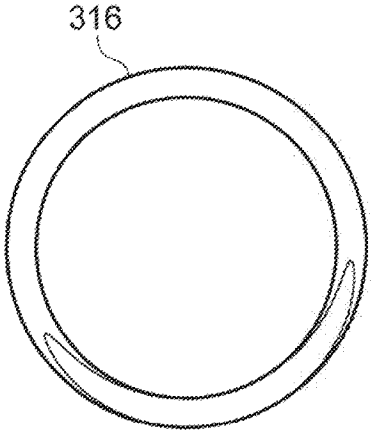
Figure 10C:
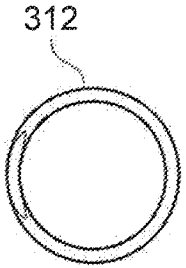
FIGS. 10*a* to 10*c* are sectional, side elevation and overall views of the pin housing spring of the instrument of FIG. 1.
Figure 10B:
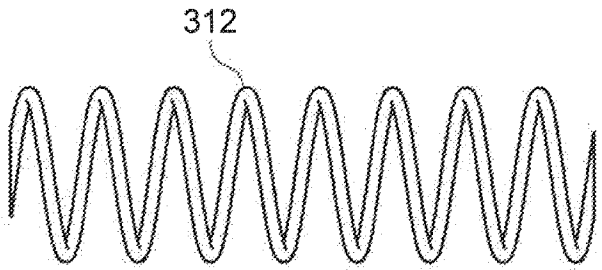
Figure 10A:
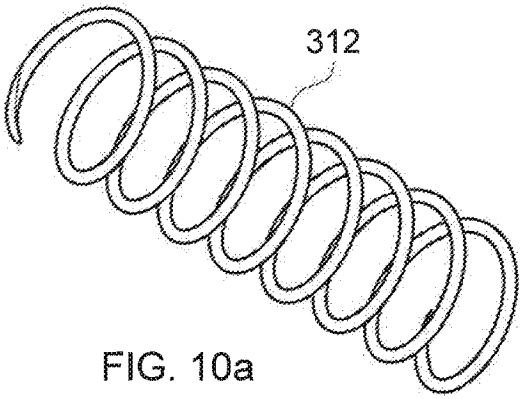
Figure 11B:
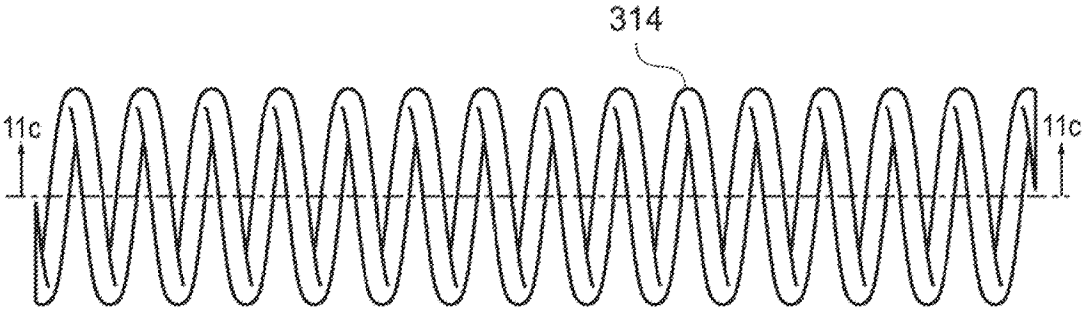
FIGS. 11*a* to 11*d* are sectional, side elevation and overall views of the main spring of the instrument of FIG. 1.
Figure 11C:
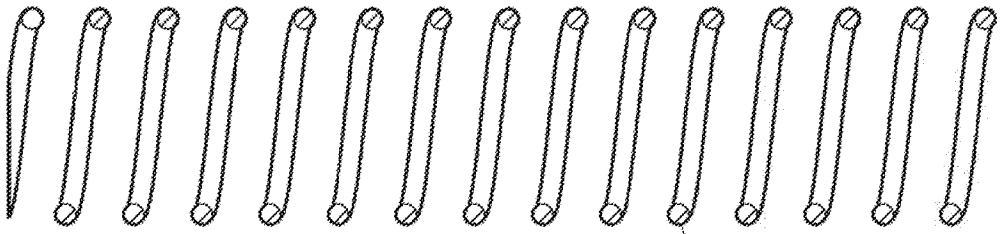
Figure 11D:
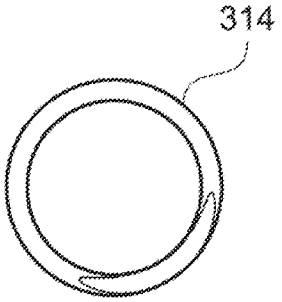
Figure 11A:
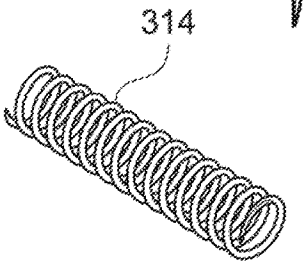
Figure 12C:
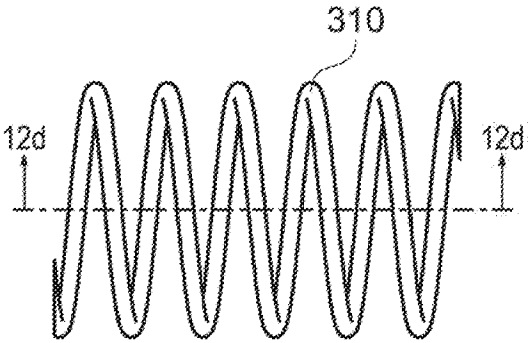
FIGS. 12 *a* to 12 *d* are sectional, side elevation and overall views of the nose spring of the instrument of FIG. 1.
Figure 12D:
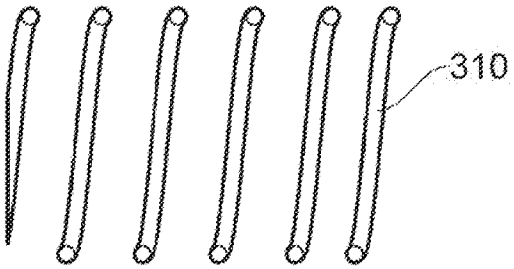
Figure 12B:
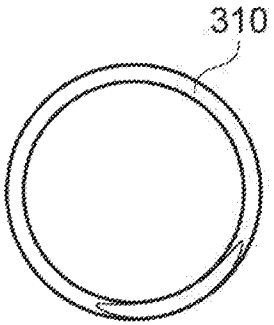
Figure 12A:
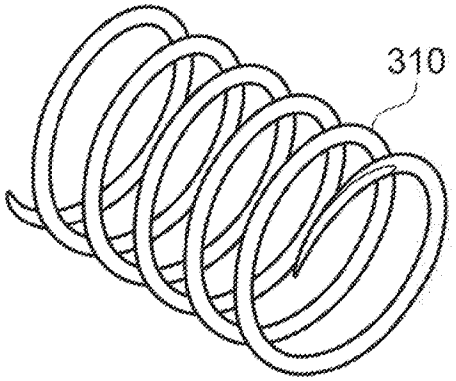
Figure 13B:
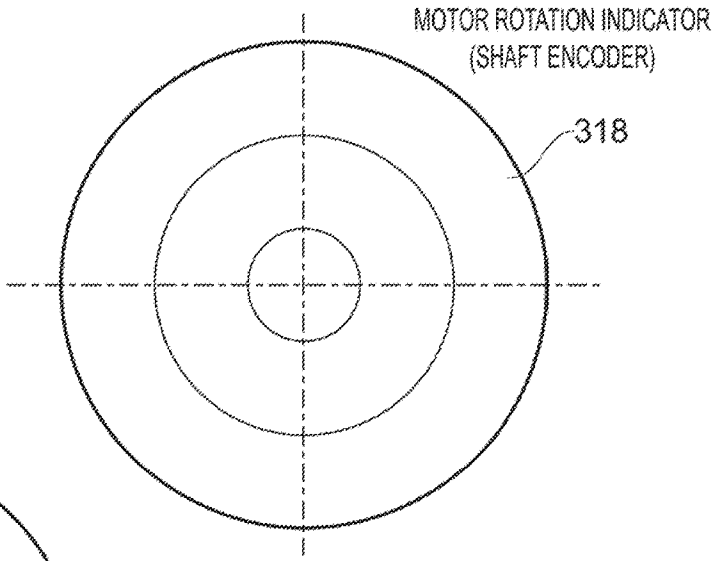
FIGS. 13*a* to 13*c* are sectional, and end elevations of the motor rotation indicator of the instrument of FIG. 1.
Figure 13C:
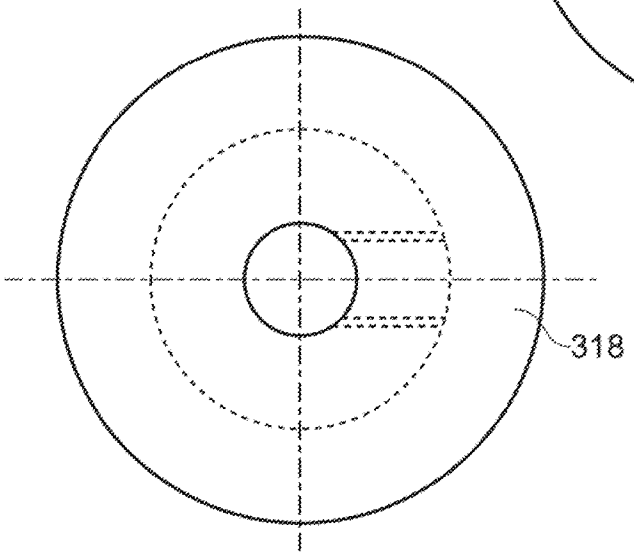
Figure 13A:
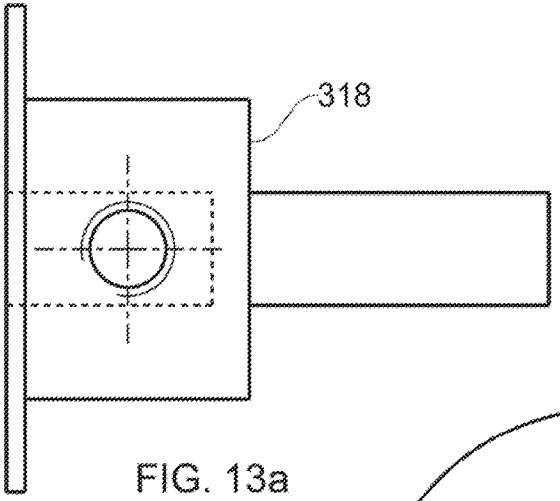
Figure 14A:
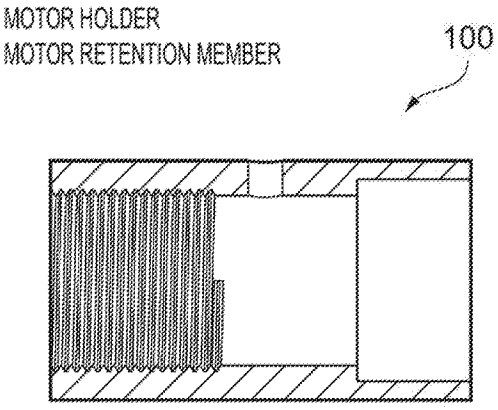
FIGS. 14*a* to 14*d* are sectional, side and end elevations and overall views of the first portion of the motor holder of the instrument of FIG. 1.
Figure 14B:
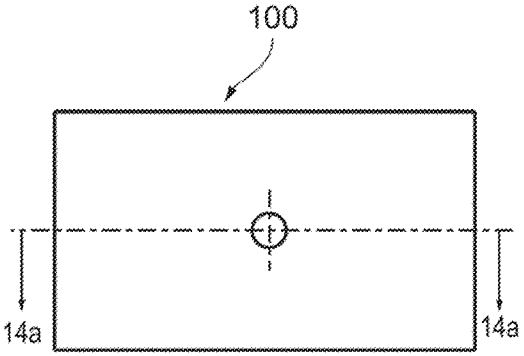
Figure 14D:
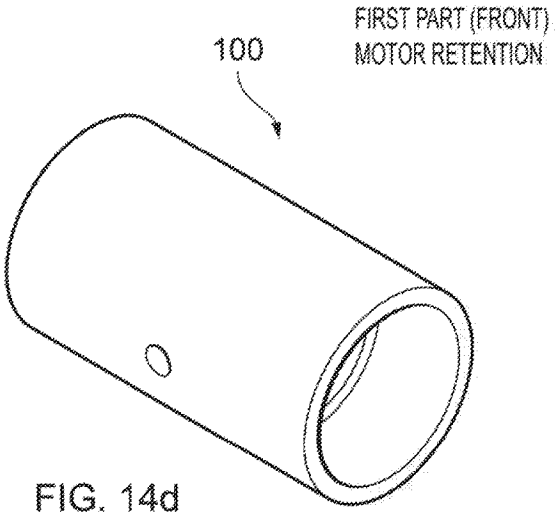
Figure 14C:
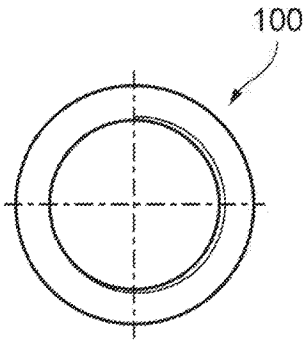
Figure 15A:
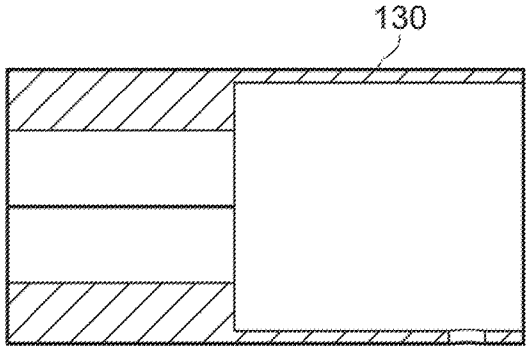
FIGS. 15*a* to 15*d* are sectional, side and end elevations and overall views of the second portion of the motor holder of the instrument of FIG. 1.
Figure 15B:
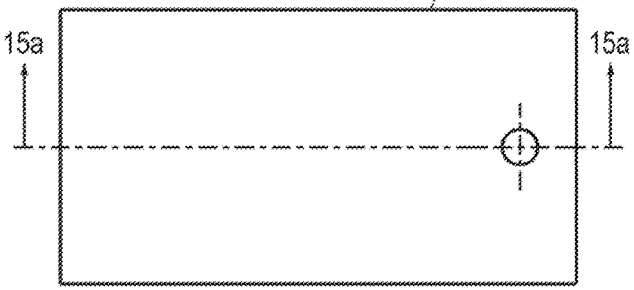
Figure 15D:
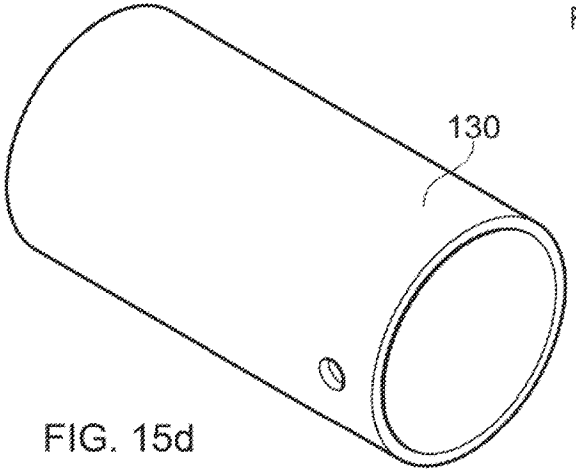
Figure 15C:
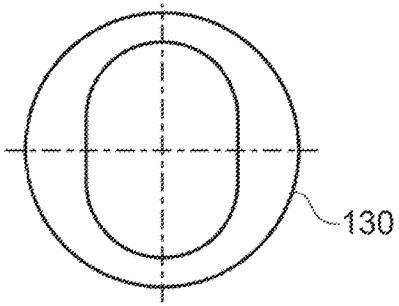
Figure 16A:
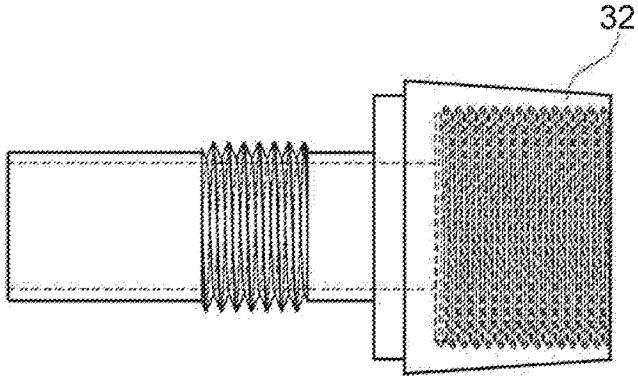
FIGS. 16*a* to 16*d* are sectional, side and end elevations and an overall view of the nose of the instrument of FIG. 1.
Figure 16B:
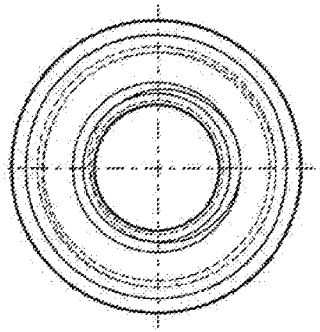
Figure 16C:
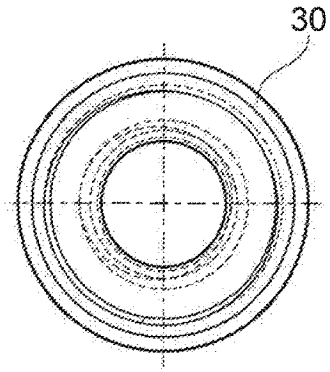
Figure 16D:
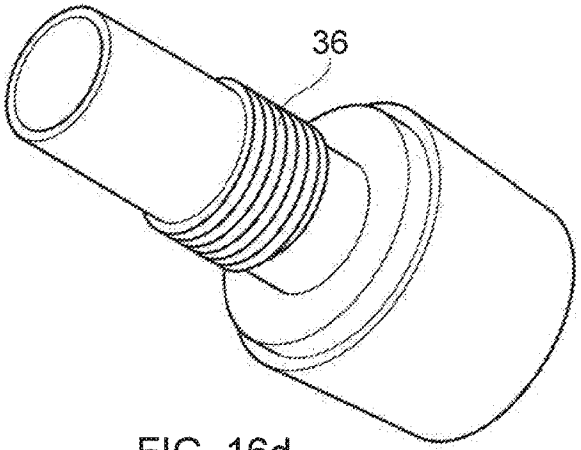
Figure 17C:
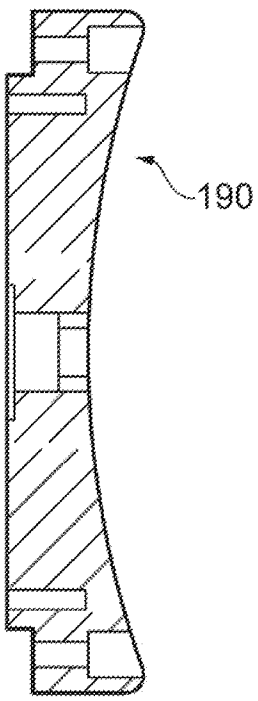
FIGS. 17*a* to 17*d* are sectional, side and end elevations and an overall view of the palm rest of the instrument of FIG. 1.
Figure 17B:
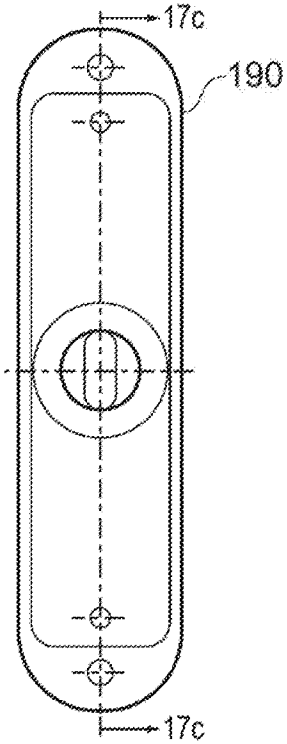
Figure 17A:
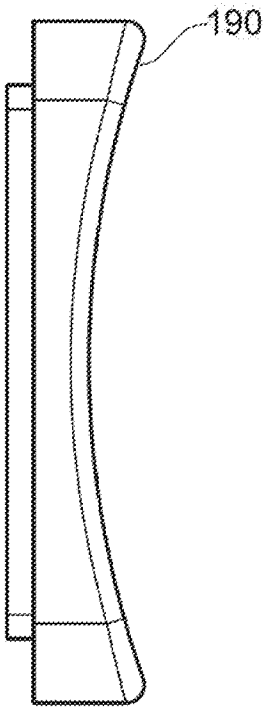
Figure 17D:
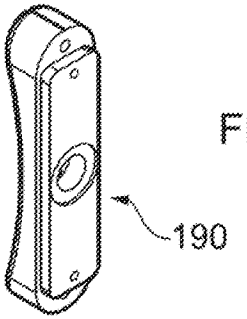
Figure 18D:
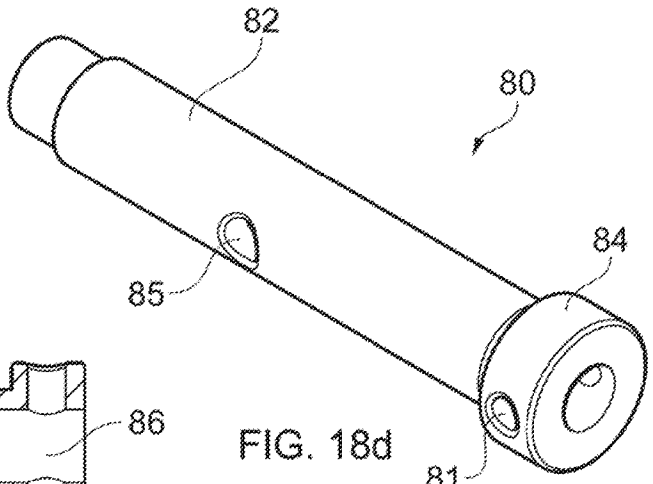
FIGS. 18*a* to 18*d* are sectional, side and end elevations and an overall view of the pin housing of the instrument of FIG. 1.
Figure 18C:
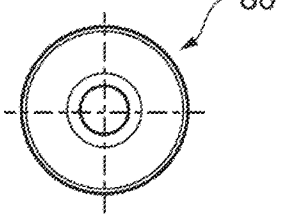
Figure 18B:
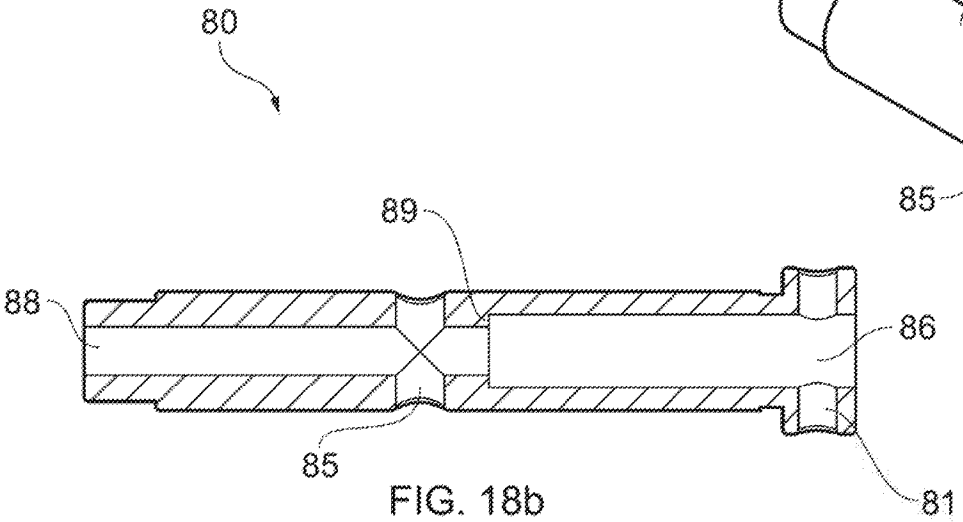
Figure 18A:
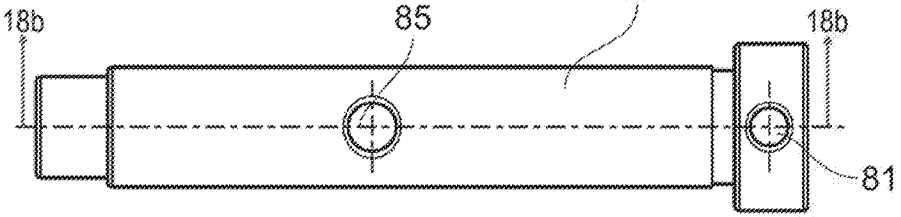
Figure 19B:
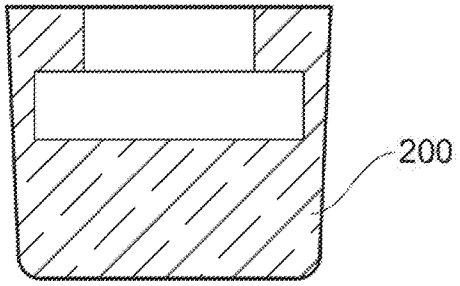
FIGS. 19*a* to 19*d* are sectional, side and end elevations and an overall view of the rubber tip of the instrument of FIG. 1.
Figure 19D:
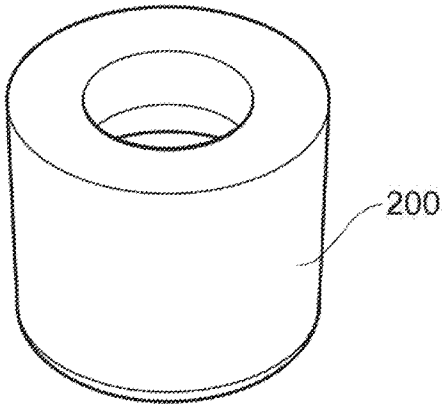
Figure 19A:
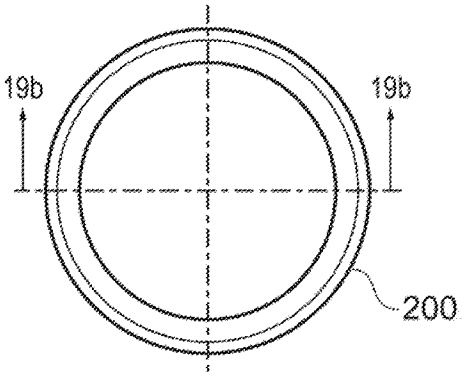
Figure 19C:
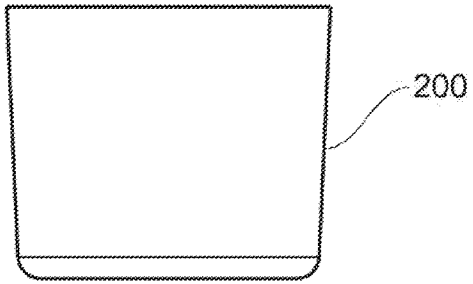
Figure 20C:
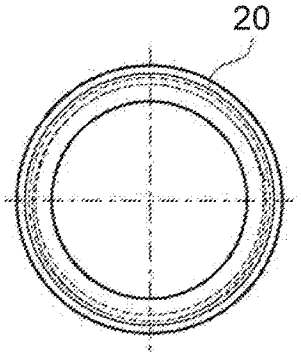
FIGS. 20*a* to 20*d* are sectional, side and end elevations and an overall view of the set ring of the instrument of FIG. 1.
Figure 20B:
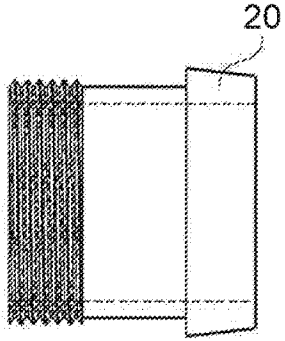
Figure 20D:
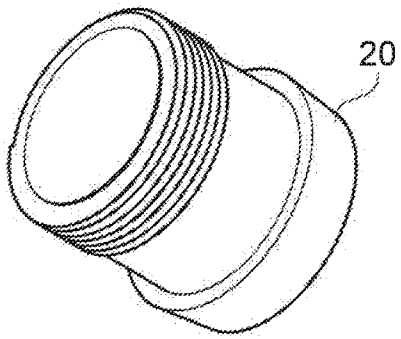
Figure 20A:
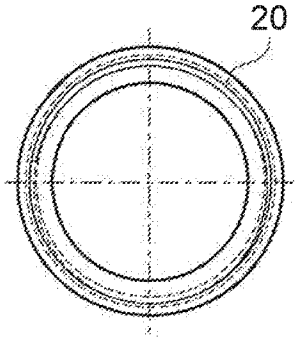
Figure 21C:
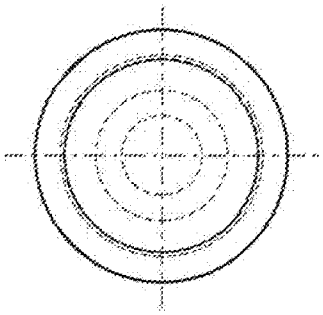
FIGS. 21*a* to 21*d* are sectional, side and end elevations and an overall view of the strength selector of the instrument of FIG. 1.
Figure 21A:
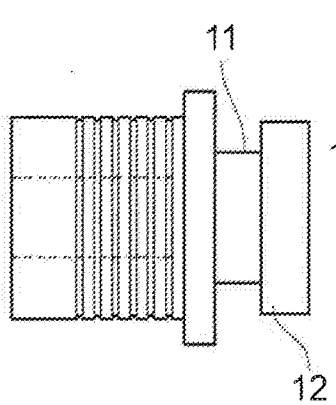
Figure 21B:
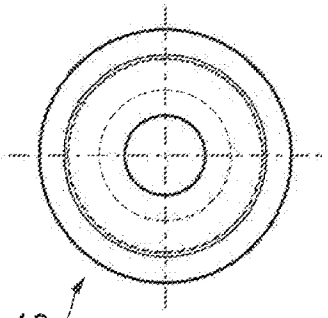
Figure 21D:
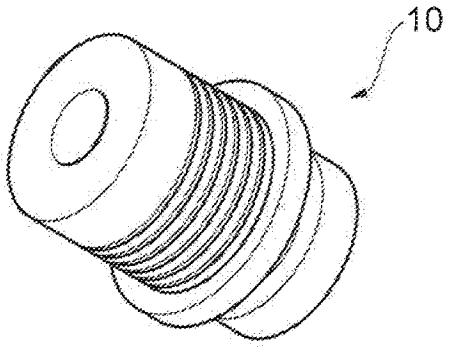

FIGS. 6*a* to 6*c* are sectional, elevation and overall views of the body of the instrument of FIG. 1. FIGS. 7*a* to 7*c* are sectional, elevation and overall views of the outer body of the instrument of FIG. 1. FIGS. 8*a* to 8*d* are sectional, front and side elevation and overall views of the handle of the instrument of FIG. 1. FIGS. 9*a* to 9*d* are sectional, front and side elevation and overall views of the internal spring of the instrument of FIG. 1. FIGS. 10*a* to 10*c* are sectional, side elevation and overall views of the pin housing spring of the instrument of FIG. 1. FIGS. 11*a* to 11*d* are sectional, side elevation and overall views of the main spring of the instrument of FIG. 1. FIGS. 12*a* to 12*d* are sectional, side elevation and overall views of the main spring of the instrument of FIG. 1. FIGS. 13*a* to 13*c* are sectional, and end elevations of the motor rotation indicator of the instrument of FIG. 1, FIGS. 14*a* to 14*d* are sectional, side and end elevations and overall views of the first portion of the motor holder of the instrument of FIG. 1. FIGS. 15*a* to 15*d* are sectional, side and end elevations and overall views of the second portion of the motor holder of the instrument of FIG. 1. FIGS. 16*a* to 16*d* are sectional, side and end elevations and an overall view of the nose of the instrument of FIG. 1.

Figure 22B:
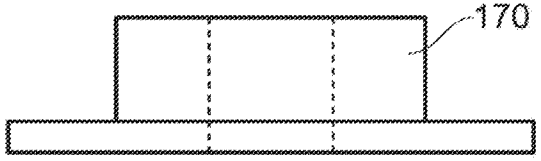
FIGS. 22*a* to 22*c* are sectional, and end elevations of the switch guide of the instrument of FIG. 1.
Figure 22A:
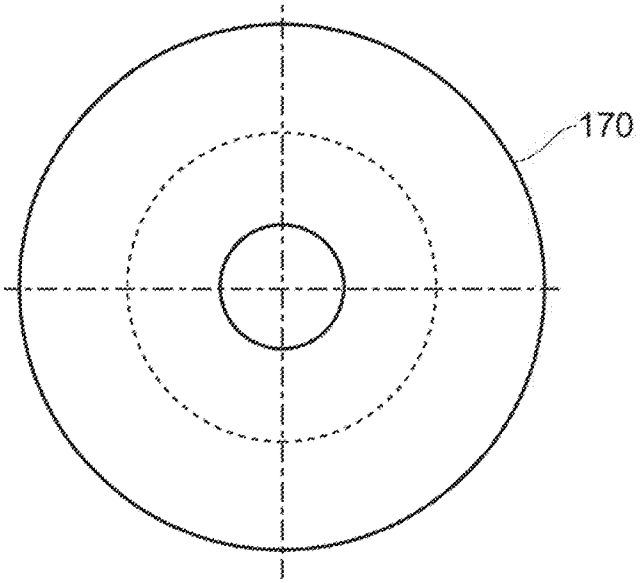
Figure 22C:
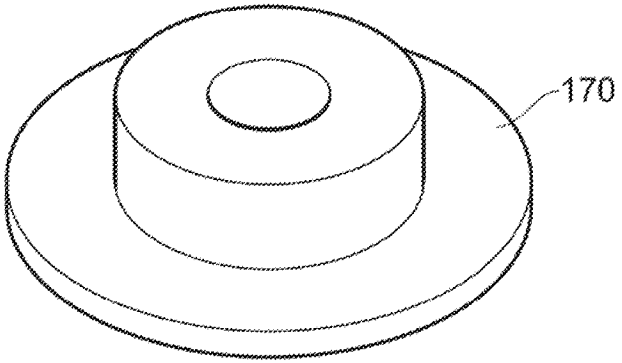
Figure 23C:
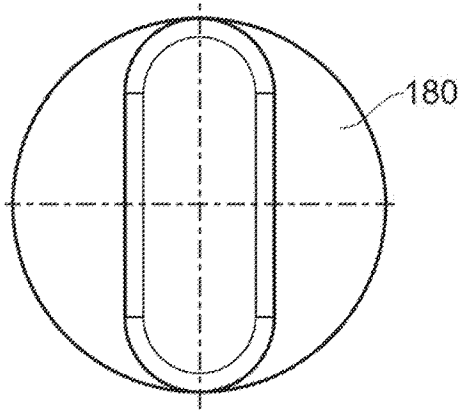
FIGS. 23*a* to 23*d* are sectional, side and end elevations and an overall view of the switch pin of the instrument of FIG. 1.
Figure 23D:
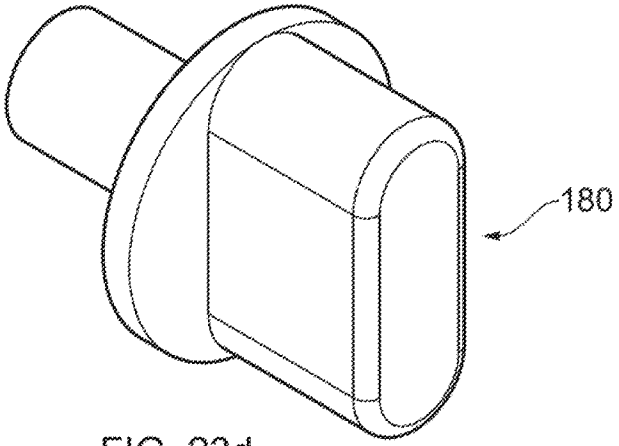
Figure 23B:
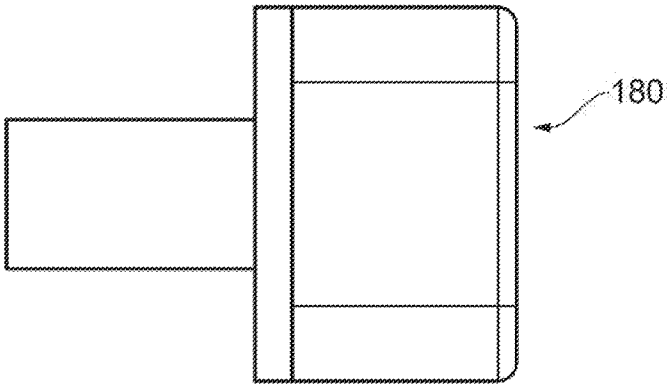
Figure 23A:
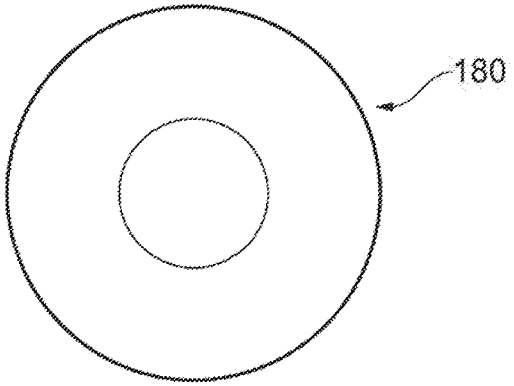
Figure 24C:
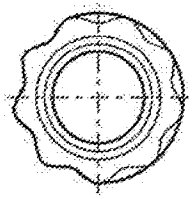
FIGS. 24*a* to 24*d* are sectional, side and end elevations and an overall view of the 9-start threaded drive of the instrument of FIG. 1.
Figure 24B:
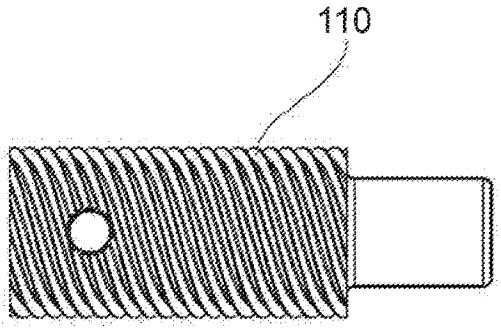
Figure 24D:
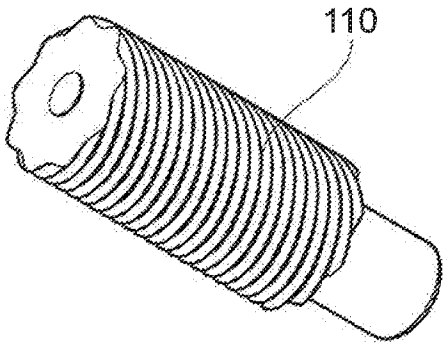
Figure 24A:
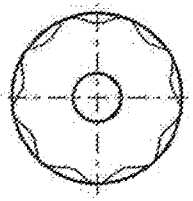
Figure 25A:
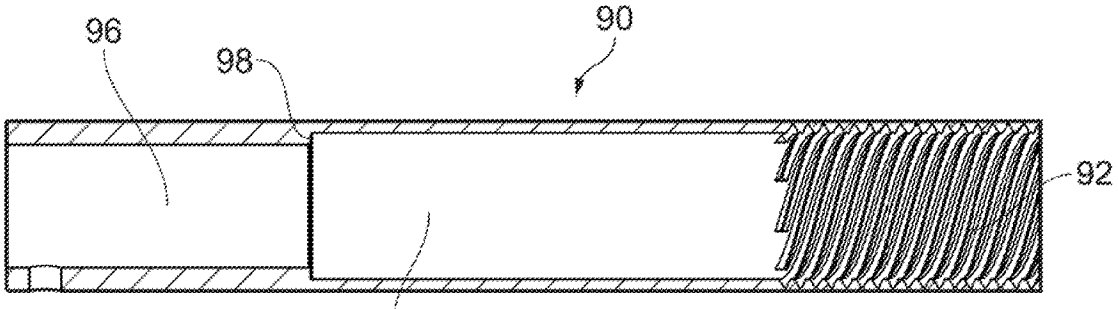
FIGS. 25*a* to 25*d* are sectional, side and end elevations and an overall view of the threaded sleeve of the instrument of FIG. 1.
Figure 25B:
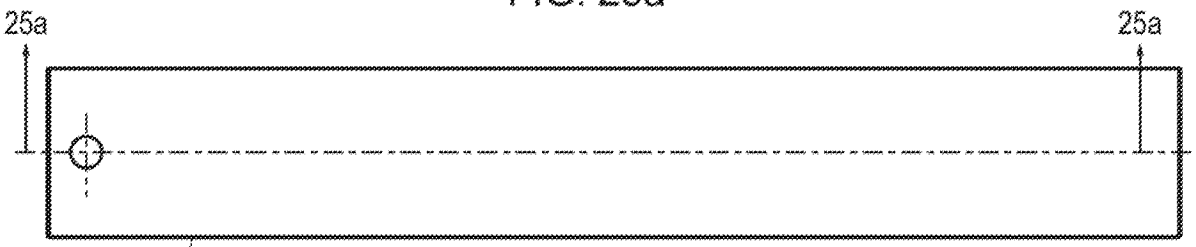
Figure 25D:
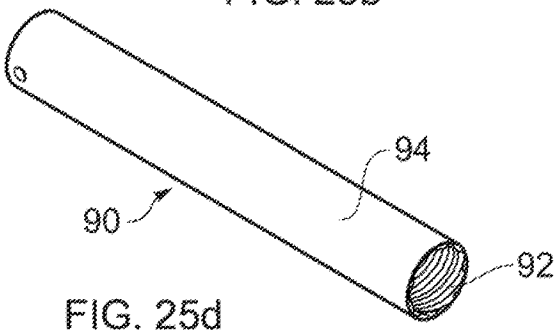
Figure 25C:
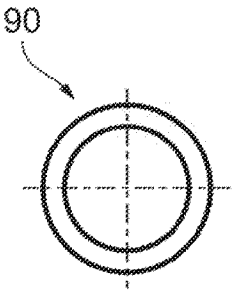

FIGS. 17*a* to 17*d* are sectional, side and end elevations and an overall view of the palm rest of the instrument of FIG. 1, FIGS. 18*a* to 18*d* are sectional, side and end elevations and an overall view of the pin housing of the instrument of FIG. 1. FIGS. 19*a* to 19*d* are sectional, side and end elevations and an overall view of the rubber tip of the instrument of FIG. 1. FIGS. 20*a* to 20*d* are sectional, side and end elevations and an overall view of the set ring of the instrument of FIG. 1. FIGS. 21*a* to 21*d* are sectional, side and end elevations and an overall view of the strength selector of the instrument of FIG. 1. FIGS. 22*a* to 22*c* are sectional, and end elevations of the switch guide of the instrument of FIG. 1. FIGS. 23*a* to 23*d* are sectional, side and end elevations and an overall view of the switch pin of the instrument of FIG. 1. FIGS. 24*a* to 24*d* are sectional, side and end elevations and an overall view of the 9-start threaded drive of the instrument of FIG. 1.

Figure 26A:
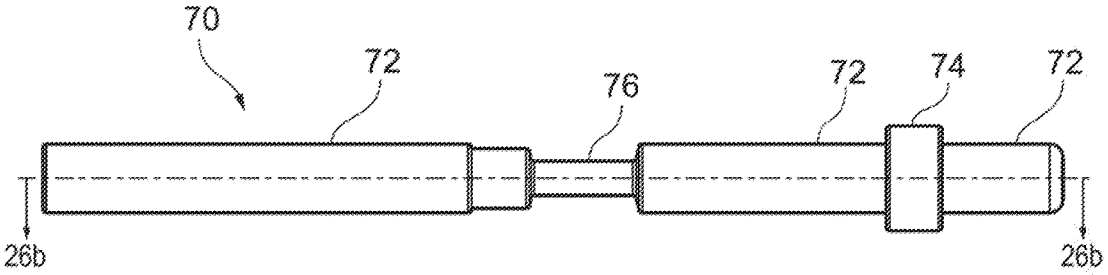
FIGS. 26*a* to 26*c* are sectional, and end elevations of the ball actuator of the instrument of FIG. 1.
Figure 26B:
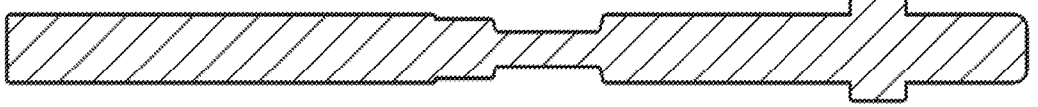
Figure 26C:
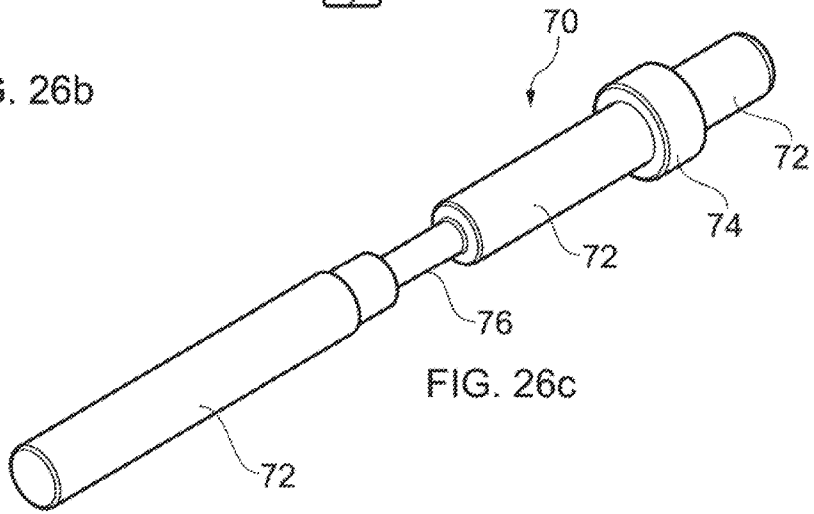

FIGS. 25*a* to 25*d* are sectional, side and end elevations and an overall view of the threaded sleeve of the instrument of FIG. 1. FIGS. 26*a* to 26*c* are sectional, and end elevations of the ball actuator of the instrument of FIG. 1.

The invention has been described by way of example, with modifications and alternatives, but, having read and understood this description, further embodiments and modifications will be apparent to those skilled in the art. In particular, it will be understood that the invention may encompass any number of different firing mechanisms.

All such embodiments and modifications are intended to fall within the scope of the present invention as defined in the accompanying claims.

The invention claimed is:

1. A cordless chiropractic adjustment device, adapted to receive at least one battery which in use provides direct current to a motor, comprising:

a thrust element capable of impacting a body contact member;

a first resilient spring arranged to bias the thrust element towards the body contact member;

a second resilient spring arranged to be held under compression by the anvil member so as to bias the thrust element away from the body contact member; and a tube member through which the thrust element propels towards the body contact member;

wherein the thrust element has a primed configuration in which sliding of the thrust element within the tube member is prevented by protrusion of a ball bearing, and a fired configuration in which the thrust element is slidable within the tube member by retraction of the ball bearing; and a set ring acting on the body contact member allowing the distance between the thrust element and the body contact member to be varied, thereby altering a peak force of a resultant thrust of the thrust element towards the body contact member;

wherein said motor is arranged to move the thrust element between:

the primed configuration, in which the thrust element is held distant from the body contact member, and the fired configuration in which the thrust element is propelled by the first resilient spring towards the body contact member; and wherein a start thread member, in communication with said motor, converts rotation of a shaft of said motor to linear movement of the thrust element via the start thread member having an external male screw thread arranged to cooperate with a female screw thread of the tube member.

2. The cordless chiropractic adjustment device according to claim 1, in which the body contact member comprises:

an anvil member.

3. The cordless chiropractic adjustment device according to claim 2, wherein:

the second resilient spring is arranged to be held under compression by the anvil member so as to control an amount of force with which the body contact member is fired.

4. The cordless chiropractic adjustment device according to claim 3, in which the amount of compression applied to the second resilient spring is adjusted by an adjustment member arranged to cause relative longitudinal movement of the anvil member.

5. The cordless chiropractic adjustment device according to claim 4, in which the adjustment member comprises:

a nose cone member, wherein rotation of the set ring causes relative longitudinal movement of the anvil member.

6. The cordless chiropractic adjustment device according to claim 1, further comprising:

a switch, wherein closure or opening of said switch is arranged to cause the motor to first propel the thrust element to the fired configuration, and subsequently withdraw the thrust element to the primed configuration.

7. The cordless chiropractic adjustment device according to claim 1, further comprising:

a recharging cradle arranged to receive the chiropractic adjustment device to recharge said at least one battery.

8. The cordless chiropractic adjustment device according to claim 7, wherein:

a switch is arranged at an end of the device directly opposite to the body contact member.

9. The cordless chiropractic adjustment device according to claim 7, wherein:

a switch is arranged centrally within a concave palm rest for seating a user 's palm to enable one-handed stabilization and activation of the device.

10. The cordless chiropractic adjustment device adapted to receive at least one battery which in use provides direct current to a motor, comprising a thrust element capable of impacting a body contact member;

a first resilient spring arranged to bias the thrust element towards the body contact member;

a second resilient spring arranged to be held under compression by the anvil member so as to bias the thrust element away from the body contact member; and a tube member through which the thrust element propels towards the body contact member;

wherein the thrust element has a primed configuration in which sliding of the thrust element within the tube member is prevented by protrusion of a ball bearing, and a fired configuration in which the thrust element is slidable within the tube member by retraction of the ball bearing; and a set ring acting on the body contact member allowing the distance between the thrust element and the body contact member to be varied, thereby altering a peak force of a resultant thrust of the thrust element towards the body contact member;

wherein said motor is arranged to move the thrust element between:

the primed configuration, in which the thrust element is held distant from the body contact member, and the fired configuration in which the thrust element is propelled by the first resilient spring towards the body contact member;

wherein a start thread member, in communication with said motor, converts rotation of a shaft of said motor to linear movement of the thrust element via the start thread member comprising a multi-start thread and having an external male screw thread arranged to cooperate with a female screw thread of the tube member.

11. The cordless chiropractic adjustment device according to claim 10, in which the body contact member comprises:

an anvil member.

12. The cordless chiropractic adjustment device according to claim 11, wherein:

the second resilient spring is arranged to be held under compression by the anvil member so as to control an amount of force with which the body contact member is fired.

13. The cordless chiropractic adjustment device according to claim 12, in which the amount of compression applied to the second resilient spring is adjusted by the set arranged to cause relative longitudinal movement of the anvil member.

14. The cordless chiropractic adjustment device according to claim 13, further comprising:

a nose cone member, wherein rotation of the set ring causes relative longitudinal movement of the anvil member.

15. The cordless chiropractic adjustment device according to claim 10, further comprising:

a switch, wherein closure or opening of said switch is arranged to cause the motor to first propel the thrust element to the fired configuration, and subsequently withdraw the thrust element to the primed configuration.

16. The cordless chiropractic adjustment device according to claim 10, further comprising:

a recharging cradle arranged to receive the chiropractic adjustment device to recharge said at least one battery.

17. The cordless chiropractic adjustment device according to claim 16 wherein:

a switch is arranged at an end of the device directly opposite to the body contact member.

18. The cordless chiropractic adjustment device according to claim 16, wherein:

a switch is arranged centrally within a concave palm rest for seating a user 's palm to enable one-handed stabilization and activation of the device.

* * * * *